US007984917B2

(12) United States Patent
Lake et al.

(10) Patent No.: US 7,984,917 B2
(45) Date of Patent: Jul. 26, 2011

(54) SUSPENSION SKATEBOARD TRUCK

(75) Inventors: Stephen Lake, La Jolla, CA (US); Richard Wilson, San Diego, CA (US)

(73) Assignee: Seal Trademarks Pty Ltd, Queensland (AU)

( * ) Notice: Subject to any disclaimer, the term of this patent is extended or adjusted under 35 U.S.C. 154(b) by 659 days.

(21) Appl. No.: 12/098,313

(22) Filed: Apr. 4, 2008

(65) Prior Publication Data

US 2009/0256324 A1 Oct. 15, 2009

(51) Int. Cl.
*A63C 1/00* (2006.01)
*A63C 17/00* (2006.01)

(52) U.S. Cl. ..... 280/87.042; 280/11.27; 280/11.28

(58) Field of Classification Search ..... 280/11.223–11.225, 11.27, 11.28, 280/11.26

See application file for complete search history.

(56) References Cited

U.S. PATENT DOCUMENTS

| | | | | |
|---|---|---|---|---|
| 2,039,153 | A * | 4/1936 | Edwards | 280/11.28 |
| 2,086,557 | A * | 7/1937 | Kaptuller | 280/11.28 |
| 2,466,070 | A * | 4/1949 | Balstad | 280/11.28 |
| 3,087,739 | A * | 4/1963 | Ware | 280/11.28 |
| 4,176,850 | A * | 12/1979 | Johnson | 280/87.042 |
| 4,194,752 | A * | 3/1980 | Tilch et al. | 280/11.28 |
| 4,403,784 | A * | 9/1983 | Gray | 280/11.28 |
| 4,515,379 | A * | 5/1985 | Pasques | 280/11.27 |
| 5,971,411 | A * | 10/1999 | Jones et al. | 280/87.042 |
| 6,343,803 | B1 * | 2/2002 | Johnston | 280/87.042 |
| 6,474,666 | B1 * | 11/2002 | Andersen et al. | 280/87.041 |
| 6,648,372 | B2 * | 11/2003 | Ojeda, III | 280/809 |
| 6,659,480 | B1 * | 12/2003 | Newman | 280/87.042 |
| 6,761,369 | B1 * | 7/2004 | Anderson | 280/87.042 |
| 7,104,558 | B1 * | 9/2006 | Saldana | 280/87.042 |
| 7,219,907 | B2 * | 5/2007 | Chang | 280/87.042 |
| 7,419,168 | B2 * | 9/2008 | Felty | 280/11.223 |
| 7,464,944 | B2 * | 12/2008 | Lyden | 280/11.27 |
| 7,631,884 | B2 * | 12/2009 | Cole | 280/87.042 |
| 2002/0011713 | A1 * | 1/2002 | Kirkland | 280/11.28 |
| 2008/0179844 | A1 * | 7/2008 | DiDomizio | 280/11.27 |

FOREIGN PATENT DOCUMENTS

| | | | |
|---|---|---|---|
| GB | 2416313 | | 1/2006 |
| GB | 2416313 | A * | 1/2006 |
| WO | 97/04844 | | 2/1997 |
| WO | 2004/014499 | | 2/2004 |

OTHER PUBLICATIONS

PCT Form ISA 220, PCT Notification of Transmittal of the International Search Report and the Written Opinion of the International Searching Authority, dated Aug. 6, 2009, issued in connection with corresponding PCT Application PCT/US2009/039672.

* cited by examiner

*Primary Examiner* — J. Allen Shriver, II
*Assistant Examiner* — Jacob Meyer
(74) *Attorney, Agent, or Firm* — Mintz Levin, Cohn, Ferris, Glovsky and Popeo P.C.

(57) ABSTRACT

A shock absorbing mechanism for a suspension skateboard truck and skateboard is disclosed. A suspension skateboard truck includes a hangar. The hangar has opposing axle sleeves that extend to opposite distal ends along a lateral axis defined by an axle channel formed by each axle sleeve. The distal end of each axle sleeve includes a cavity that has a width greater than a width of the axle channel. The apparatus further includes an axle extending out from the axle channel and cavity of the distal end of each axle sleeve, and a shock absorbing mechanism occupying each cavity at least partially around the axle.

20 Claims, 6 Drawing Sheets

SUSPENSION SKATEBOARD TRUCK

BACKGROUND

This document relates to skateboards, and more particularly to a shock absorbing mechanism for a skateboard truck and skateboard.

A skateboard typically includes a planar board, or "deck," a pair of trucks that each house an axle connected to the underside of the deck, and a wheel mounted on both sides of the axle. Most skateboards have four wheels, although it may be contemplated that some skateboards have more or less than four wheels. Most trucks are formed of metal, and include a pivoting hangar that includes the axle on which the wheels are mounted. The hangar is configured to pivot about a pivot point based on pressure applied to the topside of the planar board, and to allow the skateboard to turn.

A universal problem for skateboards, particularly in downhill or slalom-type skateboarding, is vibration from the skating surfaces on which the skateboard rolls. This vibration makes the skateboard and its rider significantly more instable. While a small amount of vibration can be absorbed by the wheels, depending on their visco-elasticity or softness, most of the vibration energy travels through the trucks to the planar board, and on to the rider. Vibration is more acute at higher speeds, and can inhibit turning and control of the skateboard by the rider.

One solution to counter or absorb vibration has been to employ riser pads between the trucks and the planar board. However, the riser pads are either not thick enough to dampen the vibration, too far removed from the source of the vibration (i.e. where the wheels connect with the skating surface), or raise the deck too high from the trucks, which itself causes further instability and stress on the bolts that hold the trucks to the deck. Further, the effects and amount of vibration experienced by the skateboard is usually more intense during turns, which adds a lateral vector of vibration energy to the overall vibration experienced by the skateboard. Riser pads are largely ineffective to counter or absorb this laterally-induced vibration.

SUMMARY

This document discloses a shock absorbing mechanism for a skateboard truck and skateboard. According to one aspect, an apparatus for a suspension skateboard truck includes a hangar. The hangar has opposing axle sleeves that extend to opposite distal ends along a lateral axis defined by an axle channel formed by each axle sleeve. The distal end of each axle sleeve includes a cavity that has a width greater than a width of the axle channel. The apparatus further includes an axle extending out from the axle channel and cavity of the distal end of each axle sleeve, and a shock absorbing mechanism occupying each cavity at least partially around the axle.

According to another aspect, a suspension skateboard truck includes a base having a plurality of mounting holes, a pivot cup, and a mounting seat that includes a kingpin receiving hole and bottom bushing seat. The suspension skateboard truck further includes a bottom bushing provided on the bottom bushing seat, and a hangar. The hangar includes a pivot stem pivotally coupled with the pivot cup, a bushing ring resting on the first bushing, and opposing axle sleeves that extend to opposite distal ends along a lateral axis defined by an axle channel formed by each axle sleeve, the distal end of each axle sleeve including a cavity that has a width greater than a width of the axle channel. The suspension skateboard truck further includes a top bushing provided on the top bushing seat, a kingpin threaded through the top bushing, the bushing ring, the bottom bushing, and coupled to the kingpin receiving hole, and an axle extending out from the axle channel and cavity of the distal end of each axle sleeve. The suspension skateboard truck further includes a shock absorbing mechanism occupying each cavity at least partially around the axle.

In yet another aspect, a skateboard is presented which includes a planar board having a top side and a bottom side, and a pair of suspension skateboard trucks mounted to the bottom side of the planar board. Each suspension skateboard truck includes a base having a plurality of mounting holes, a pivot cup, and a mounting seat that includes a kingpin receiving hole and bottom bushing seat. Each truck further includes a bottom bushing provided on the bottom bushing seat, and a hangar having a pivot stem pivotally coupled with the pivot cup. Each suspension skateboard truck further includes a bushing ring resting on the first bushing, and opposing axle sleeves that extend to opposite distal ends along a lateral axis defined by an axle channel formed by each axle sleeve. The distal end of each axle sleeve includes a cavity that has a width greater than a width of the axle channel. Each suspension skateboard truck further includes a top bushing provided on the top bushing seat, a kingpin threaded through the top bushing, the bushing ring, the bottom bushing, and coupled to the kingpin receiving hole, an axle extending out from the axle channel and cavity of the distal end of each axle sleeve, and a shock absorbing mechanism occupying each cavity at least partially around the axle. The skateboard further includes four wheels, each wheel being mounted on each axle that extends out from the axle channel. The suspension skateboard truck absorbs vibrations and other energy from the wheels and/or the planar board.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a shock absorbing mechanism for a skateboard, and more particularly a shock absorbing mechanism for use in a suspension skateboard truck. The shock absorbing mechanism absorbs jolts, vibrations and lateral stresses from riding the skateboard, and which previously had been transmitted from the wheels, through the trucks and to the deck, where they were ultimately felt by the rider.

Figure 2:
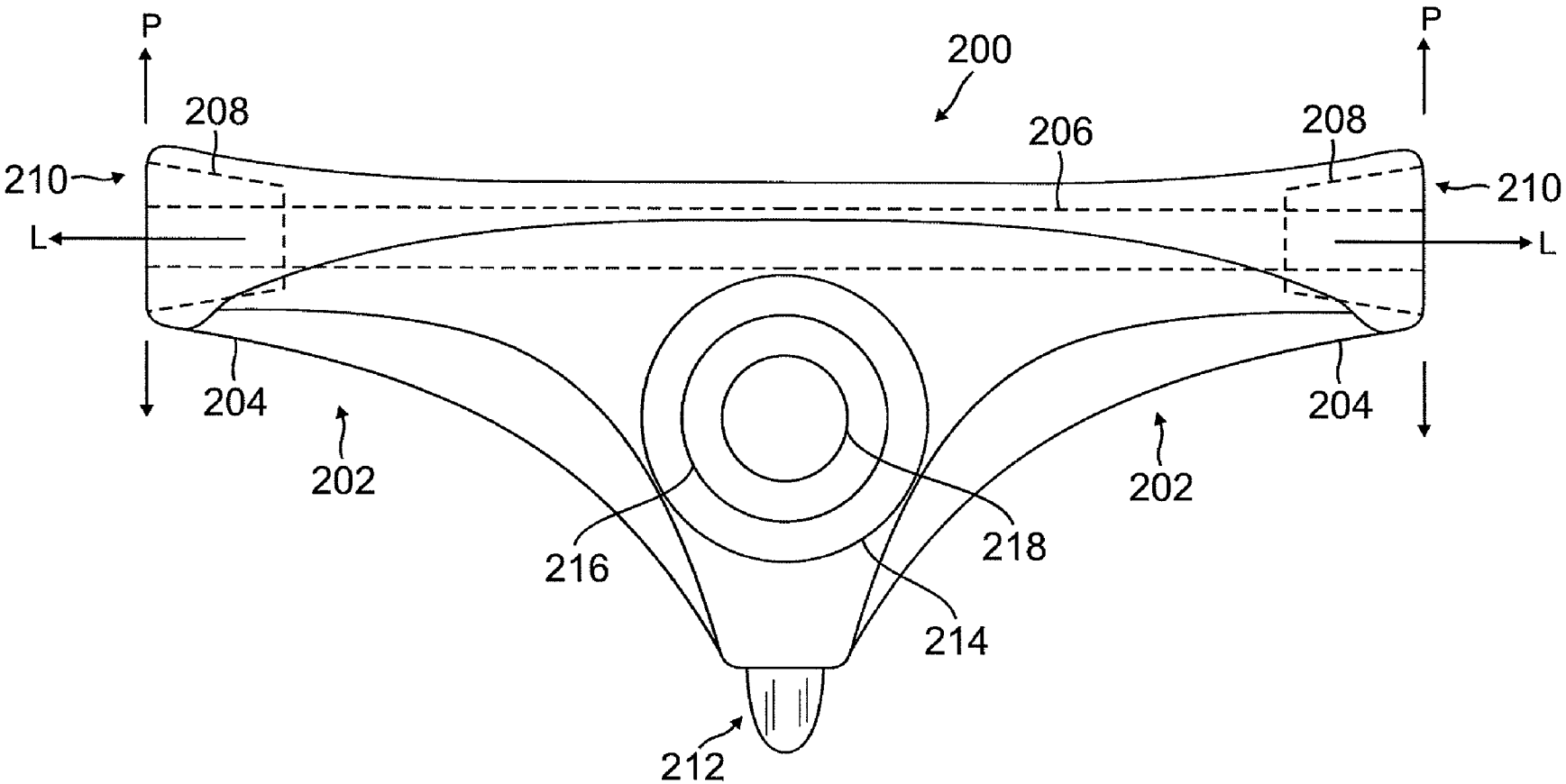
FIG. 2 illustrates a hangar of a skateboard truck that employs a shock absorbing mechanism.

FIG. 2 illustrates one type of hangar 200 of a skateboard truck that employs a shock absorbing mechanism. The hangar 200 has opposing axle sleeves 202 that extend to opposite distal ends 204 along a lateral axis L. The lateral axis L is defined by an axle channel 206 formed by each axle sleeve 202. The axle channel 206 is preferably cylindrical, and is sized and adapted to at least partially encase an axle (not shown). The axle may be "floating," i.e. at least partially free within the axle channel 206, or the axle may be "fixed," i.e. connected and immovable within the axle channel 206. The distal end 204 of each axle sleeve 202 includes a cavity 208 that has a width that is greater than a width of the axle channel 206. The hangar 200 further includes a pivot stem 212 and a bushing ring 214. The bushing ring 214 provides a top bushing seat 216 and a kingpin aperture 218, the functions of which are described in further detail below.

The cavity 208 is sized and adapted to be occupied by a shock absorbing mechanism, also described in further detail below. In one preferred implementation, the cavity 208 is a recess provided into an outer face 210 of the distal end 204 of each axle sleeve 202, in which the outer face 210 defines a plane P that is transverse to the lateral axis L. In some implementations, the recess is cylindrical, having a diameter that is greater than the diameter of the axle channel 206. In other implementations, the recess has a truncated cone shape. The larger diameter side of the truncated cone preferably, but not necessarily, faces out of the outer face 210.

The cavity 208 can be any size, but which still allows the distal end 204 of each axle sleeve 202 to maintain strength and rigidity. For example, the cavity 208 can be a single recess, or a first recess within a second recess. The recess may have multiple steps, and may extend toward the middle of the hangar 200 beyond a major portion of the axle sleeve 202. In a preferred exemplary implementation, the recess is between 1 and 3 centimeters inset from the outer face 210 and plane P.

Figure 3A:
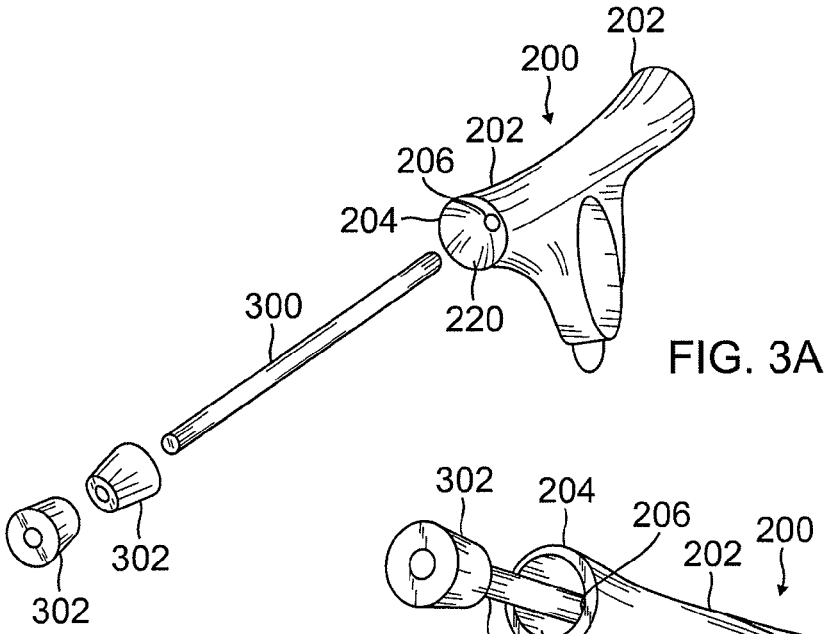
FIGS. 3A-C illustrate a shock absorbing mechanism for a suspension skateboard truck.
Figure 3B:
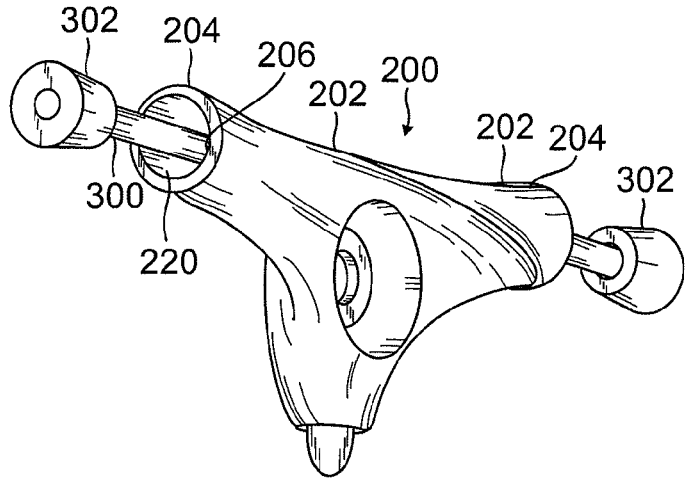
Figure 3C:
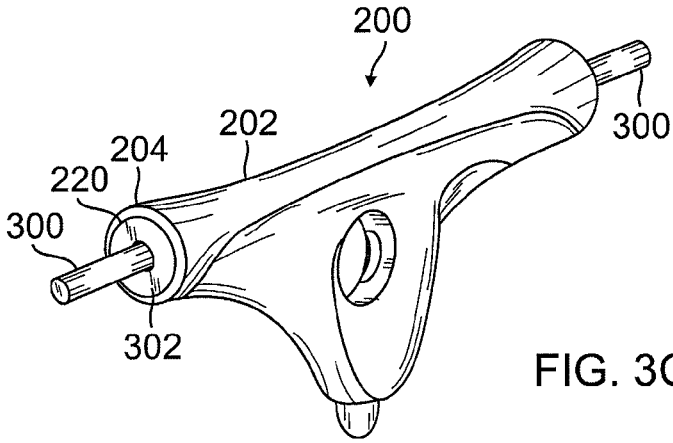

FIGS. 3A-C illustrate a shock absorbing mechanism for a suspension skateboard truck. FIG. 3A is an exploded view of a hangar 200, as substantially described above with respect to FIG. 2, having an axle 300 adapted to fit within an axle channel 206 in axle sleeve 202, and left and right shock absorbers 302 that are configured to fit over the axle 300 and occupy a cavity 206 at the distal end 204 of each axle sleeve 202. As shown, the cavity 206 is implemented as a recess 220 into an outer face of the distal end 204 of the axle sleeve 202. FIG. 3B is a slightly exploded view showing the axle 300 positioned in the axle channel of the hangar 200 and extending out from each axle sleeve 202. The left and right shock absorbers 302 are placed on ends of the axle 300, to be slid toward recess 220 that forms the cavity. FIG. 3C shows the shock absorbers 302 firmly occupying the recess 220 and around the axle 300.

In some implementations, the shock absorbers 302 are pliable bushings formed of an elastomer such as polyurethane. Other materials can be used, such as other polymers and thermoplastics, as well as rubber. The shock absorbers 302 can be solid, except for the channel that corresponds to the axle channel of the hangar, or can include grooves or other air pockets. The shock absorbers 302 preferably have a durometer of 50-75 A, although can have durometers of between 25-100 A. Further, the shock absorbers 302 can be multi-layered and composed of different materials having different durometers. Thus, in some implementations, the shock absorbers 302 can be dual or multi-durometer, with an inner core having a first durometer and an outer core having a second durometer, for example, or of a layered or hub construction.

Figure 4A:
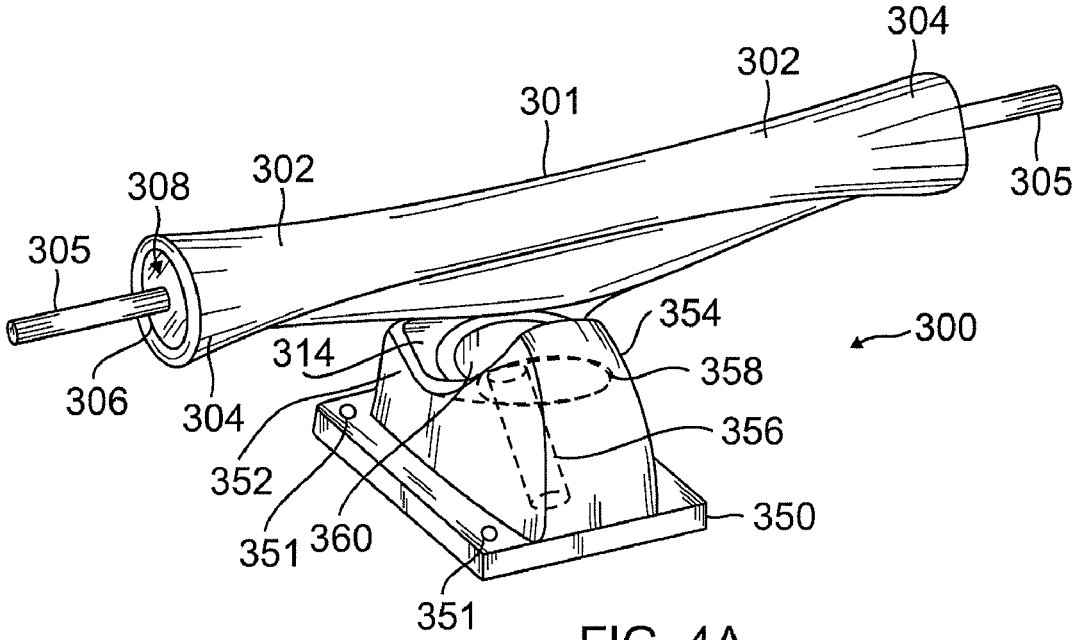
FIGS. 4A-B show front and back perspective views of a suspension skateboard truck.
Figure 4B:
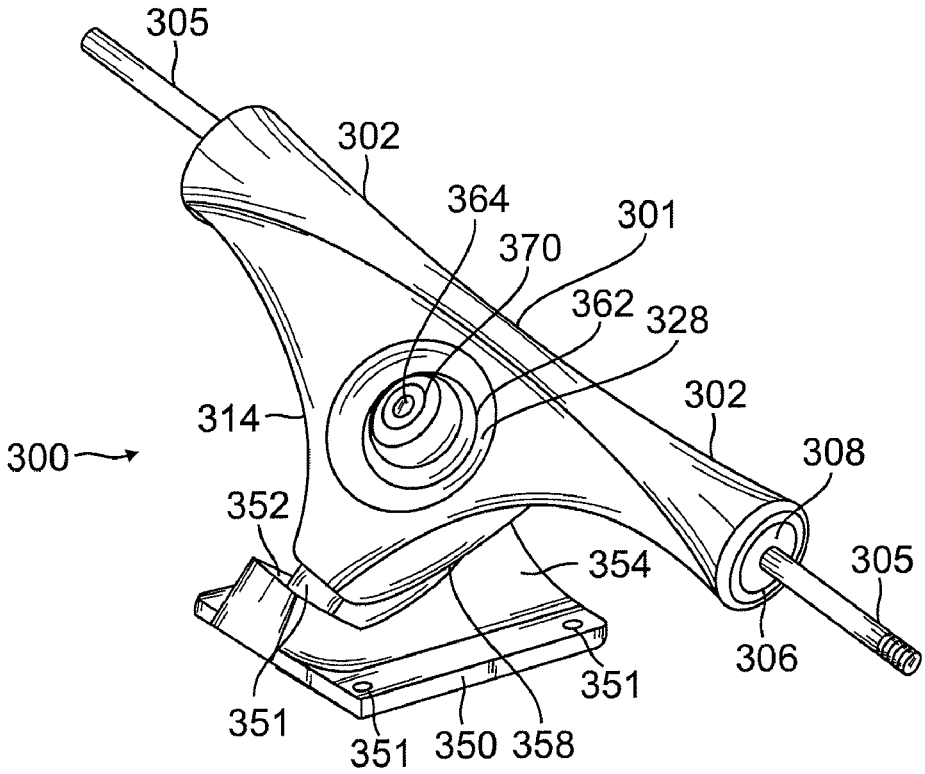

FIGS. 4A-B show front and back perspective views, respectively, of a suspension skateboard truck 300. The suspension skateboard truck 300 includes a hanger 301 pivotally coupled with a base 350. The base 350 has a number of mounting holes 351, a pivot cup 352 for receiving a pivot stem 312 of the hangar 301, and a mounting seat 354. The mounting seat 354 includes a kingpin receiving hole 356 and a bottom bushing seat 358. The hangar 301 includes a bushing ring 314, and opposing axle sleeves 302 that extend to opposite distal ends 304 along a lateral axis defined by an axle channel formed by each axle sleeve 302, and an axle 305 extending out from the axle channel and cavity 306 of the distal end 304 of each axle sleeve 302. The bushing ring 314 provides a top bushing seat 328.

The suspension skateboard truck 300 further includes a bottom bushing 360 provided on the bottom bushing seat 358, a top bushing 362 provided on the top bushing seat 328, and a kingpin 364 threaded through the top bushing 362, the bushing ring 314, the bottom bushing 360, and coupled to the kingpin receiving hole 356. The kingpin 364 can be secured to the kingpin receiving hole 356 by a bolt 370, which in turn can be tightened or loosened to decrease or increase the tension in the bushings 360 and 362, to inversely alter the pivotability of the hangar 301 against the base 350, and thus the turnability of the skateboard.

The distal end 304 of each axle sleeve 302 includes a cavity 306 having a width that is greater than a width of the axle channel, as discussed above. A shock absorbing mechanism 308 occupies each cavity 306, at least partially around the axle 305. A wheel (not shown) can then be mounted on each end of the axle 305, and when used, vibrations, jolts or other stresses experienced by each wheel are at least partially absorbed and dampened by the shock absorbing mechanism (s) 308.

Figure 5A:
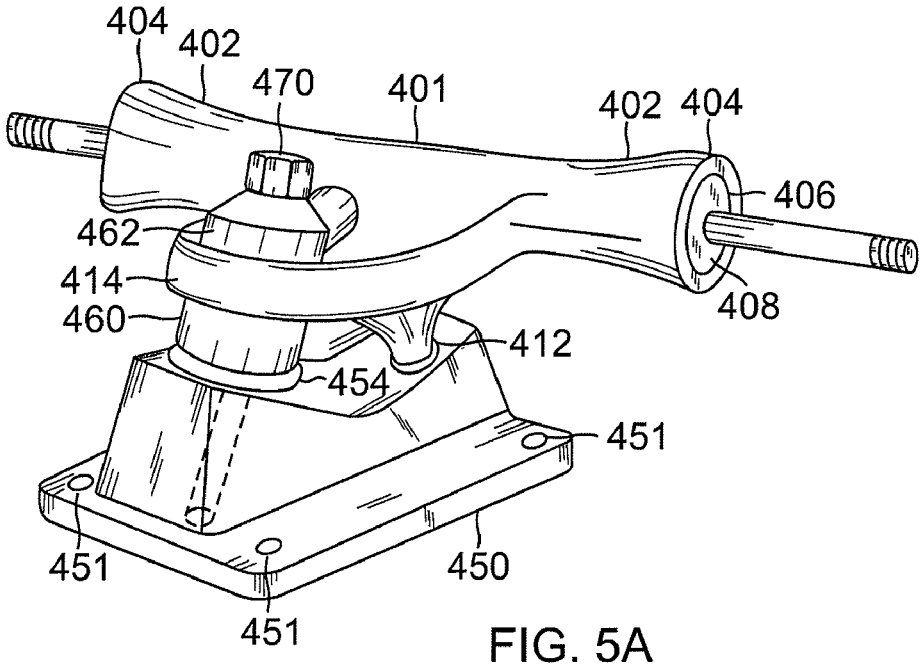
FIGS. 5A-B show front and back perspective views of an alternative suspension skateboard truck.
Figure 5B:
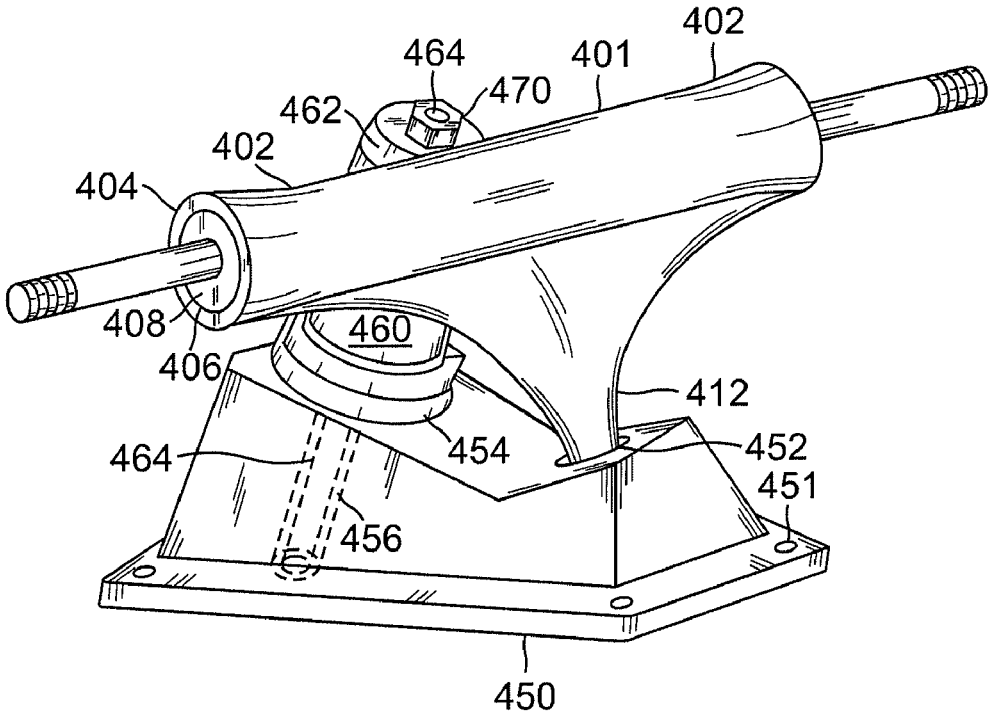

FIGS. 5A-B show front and back perspective views, respectively, of an alternative suspension skateboard truck 400, in which a bushing ring 414 of hangar 401 extends on an opposite side as a pivot stem 412. The suspension skateboard truck 400 is a preferred design for "vert" (i.e. bowls or ramps) or "street" (grind rails, steps, etc.) style riding.

Similar to suspension skateboard truck 300, the suspension skateboard truck 400 includes a hanger 401 pivotally coupled with a base 450. The base 450 has a number of mounting holes 451, a pivot cup 452 for receiving a pivot stem 412 of the hangar 401, and a mounting seat 454. The mounting seat 454 includes a kingpin receiving hole 456 and a bottom bushing seat 458. The hangar 401 includes a bushing ring 414, and opposing axle sleeves 402 that extend to opposite distal ends 404 along a lateral axis defined by an axle channel formed by each axle sleeve 402, and an axle 405 extending out from the axle channel and cavity 406 of the distal end 404 of each axle sleeve 402. The bushing ring 414 provides a top bushing seat 428.

The suspension skateboard truck 400 further includes a bottom bushing 460 provided on the bottom bushing seat 458, a top bushing 462 provided on the top bushing seat 428, and a kingpin 464 threaded through the top bushing 462, the bushing ring 414, the bottom bushing 460, and coupled to the kingpin receiving hole 456. The kingpin 464 can be secured to the kingpin receiving hole 456 by a bolt 470, which in turn can be tightened or loosened to decrease or increase the tension in the bushings 460 and 462, to inversely alter the pivotability of the hangar 401 against the base 450, and thus the turnability of the skateboard.

The distal end 404 of each axle sleeve 402 includes a cavity 406 having a width that is greater than a width of the axle channel, as discussed above. A shock absorbing mechanism 408 at least partially and preferably completely occupies each cavity 406, around the axle 405. A wheel (not shown) can then be mounted on each end of the axle 405, and when used, vibrations, jolts or other stresses experienced by each wheel are at least partially absorbed and dampened by the associated shock absorbing mechanism(s) 408.

Figure 6A:
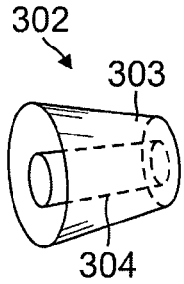
FIGS. 6A-E show various configurations and implementations of a shock absorbing mechanism.

FIGS. 6A-E show various configurations and embodiments of a shock absorbing mechanism 302. FIG. 6A is a perspective view of a shock absorbing mechanism 302, formed of a shock absorbing material 303 in the shape of shock absorbing member. In a preferred exemplary implementation, the shock absorbing member has a truncated cone shape with an inner channel 304 through which a skateboard truck axle is configured to extend. Thus, the inner channel 304 can be cylindrical, and preferably corresponds to the diameter of the axle. The shock absorbing material can be formed of any material such as rubber, polyurethane, or any other material having a durometer that is lower than the truck or axle.

Figure 6B:
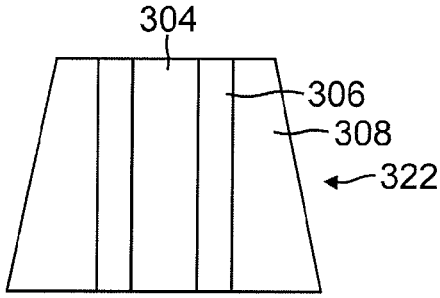

FIG. 6B is a cross-sectional view of one alternate configuration of a shock absorbing mechanism 322, which includes a first shock absorbing member 306 and a second shock absorbing member 308. The first and second shock absorbing members 306 and 308 have different durometers, or can be formed of different shock absorbing materials. While FIG. 6B illustrates the first shock absorbing member 306 as having an inner channel 304, and the second shock absorbing member 308 as being radially layered around the first shock absorbing material. Other configurations are possible, such as a layering in the lateral direction, or a configuration in which the first shock absorbing member 306 forms a core within the second shock absorbing member 308. Furthermore, more than two materials may be used for the shock absorbing mechanism 322.

Figure 6C:
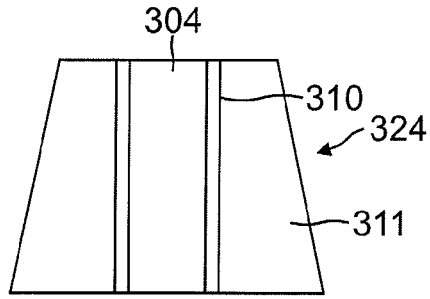

FIG. 6C is a cross-sectional view of another alternate configuration of a shock absorbing mechanism 324 that includes a hub 310 that defines the inner channel 304, and around which a shock absorbing member 311 is provided. The hub 310 can be a rigid or semi-rigid cylinder, made out of a material such as metal, nylon, or carbon fiber. The hub 310 can make sliding the shock absorbing mechanism 324 on the axle easier. Those having skill in the art would recognize that shock absorbing member 311 can be made of one or more different types of shock absorbing materials, layers, configurations, etc.

Figure 6D:
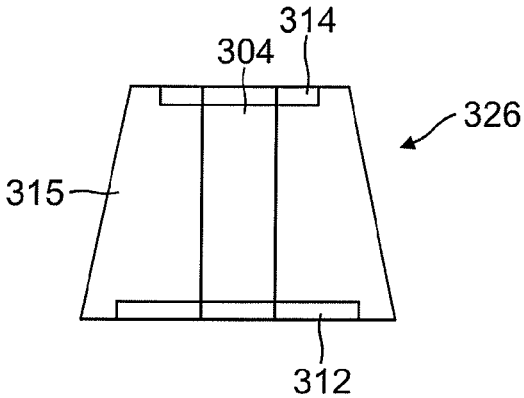
Figure 6E:
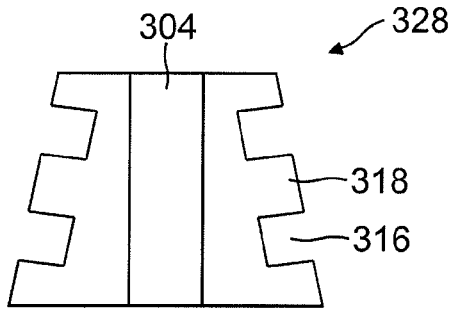

FIG. 6D is a cross-sectional view of yet another alternate configuration of a shock absorbing mechanism 326, having one or more spacers 312, 314 embedded in the shock absorbing member 315. For instance, a spacer 312 can be placed at the open face side of the shock absorbing mechanism 326 for placement close to a wheel mounted on the axle. A spacer 314 can be placed at the side of the shock absorbing mechanism toward the middle of the truck. The spacers 312/314 can provide stability, rigidity and protection of the shock absorbing material(s) that forms the shock absorbing mechanism 326. Spacers 312 and/or 314 can be used in combination with hub 310 in FIG. 6C, or with multiple shock absorbing materials as described above. FIG. 6E shows a shock absorbing mechanism 328 that includes a number of grooves or spaces 316 in the shock absorbing member 318, to utilize air or other fluid to dampen vibrations, shocks, jolts or other unwanted energy.

Figure 1:
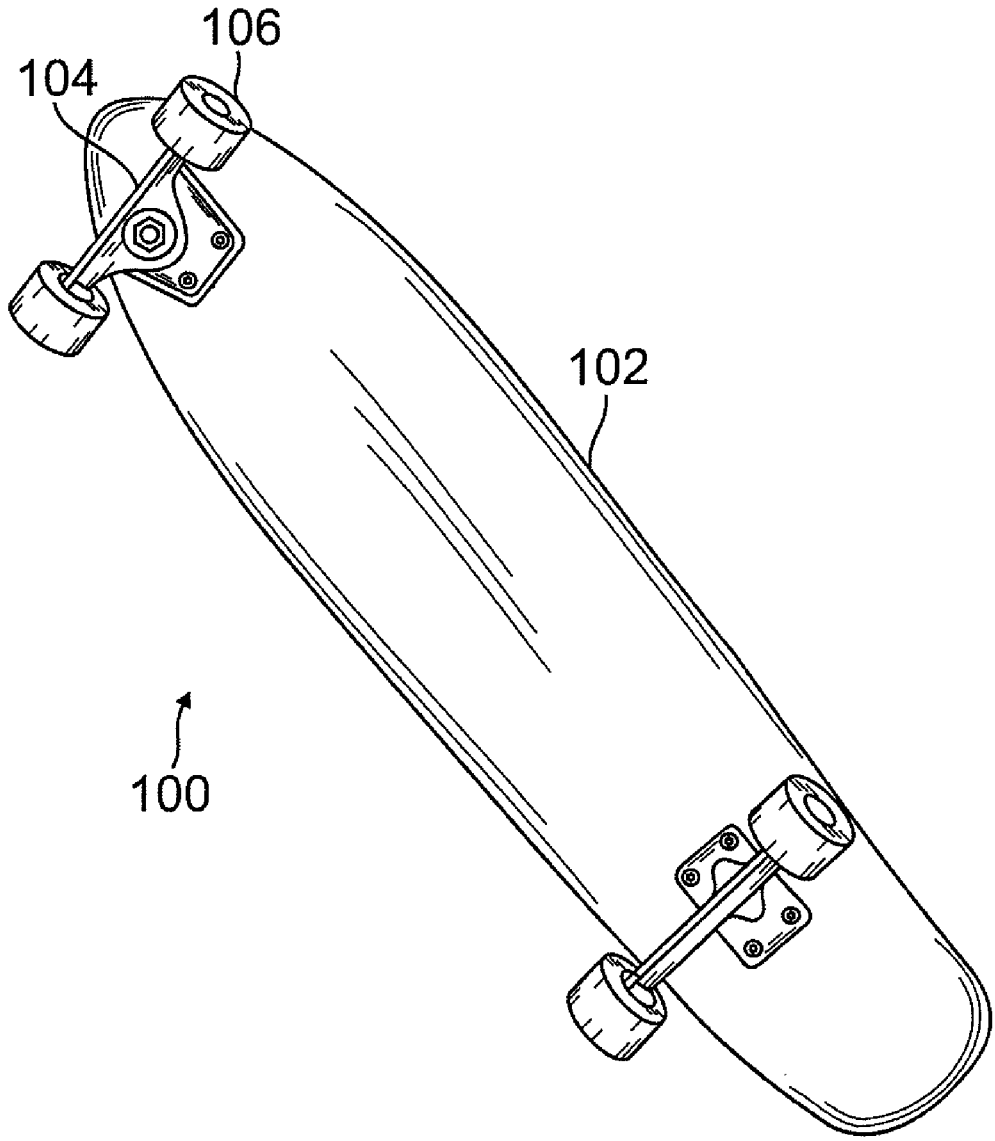
FIG. 1 illustrates a skateboard using a suspension skateboard truck.

The shock absorbing mechanism and suspension skateboard truck as described above can be employed in an assembled skateboard 100, as illustrated in FIG. 1. The skateboard 100 can include a pair of suspension skateboard trucks 104, each truck having two wheels 106 mounted thereon. As a rider operates the skateboard 100, vibrations, shocks, jolts or other undesirable energy on the wheels, from the surface or via certain moves on the skateboard 100, can be at least partially absorbed by the suspension skateboard trucks 104. Accordingly, movement and operation of the skateboard 100 is improved, and the rider experiences a smoother, more controlled ride.

Although a few embodiments have been described in detail above, other modifications are possible. Other embodiments may be within the scope of the following claims.

The invention claimed is:

1. An apparatus for a suspension skateboard truck, the apparatus comprising:

a hangar having opposing axle sleeves that extend to opposite distal ends along a lateral axis defined by an axle channel formed by each axle sleeve, the distal end of each axle sleeve including a cavity that has a width greater than a width of the axle channel, the cavity comprising a recess provided into an outer face of the distal end of each axle sleeve, the recess being radially symmetric about the lateral axis, and the outer face defining a plane that is transverse to the lateral axis;

an axle extending out from the axle channel and cavity of the distal end of each axle sleeve; and a shock absorbing mechanism occupying each cavity at least partially around the axle.

2. The apparatus of claim 1, wherein the recess has a truncated cone shape, and the shock absorbing mechanism includes a shock absorbing material formed in the truncated cone shape.

3. The apparatus of claim 1, wherein the shock absorbing mechanism includes a shock absorbing member formed of at least one shock absorbing material.

4. The apparatus of claim 3, wherein the at least one shock absorbing material includes polyurethane.

5. The apparatus of claim 1, wherein the shock absorbing mechanism includes a polyurethane bushing having a size and shape that corresponds with the size and shape of cavity.

6. A suspension skateboard truck comprising:

a base having a plurality of mounting holes, a pivot cup, and a mounting seat that includes a kingpin receiving hole and bottom bushing seat;

a bottom bushing provided on the bottom bushing seat;

a hangar having a pivot stem pivotally coupled with the pivot cup, a bushing ring resting on the first bushing, and opposing axle sleeves that extend to opposite distal ends along a lateral axis defined by an axle channel formed by each axle sleeve, the distal end of each axle sleeve including a cavity that has a width greater than a width of the axle channel;

a top bushing provided on the top bushing seat;

a kingpin threaded through the top bushing, the bushing ring, the bottom bushing, and coupled to the kingpin receiving hole;

an axle extending out from the axle channel and cavity of the distal end of each axle sleeve; and a shock absorbing mechanism occupying each cavity at least partially around the axle.

7. The apparatus of claim 6, wherein the cavity comprises a recess provided into an outer face of the distal end of each axle sleeve, the outer face defining a plane that is transverse to the lateral axis.

8. The apparatus of claim 7, wherein the recess has a truncated cone shape, and the shock absorbing mechanism includes a shock absorbing material formed in the truncated cone shape.

9. The apparatus of claim 7, wherein the recess is radially symmetric about the lateral axis.

10. The apparatus of claim 6, wherein the shock absorbing mechanism includes a shock absorbing member formed of at least one shock absorbing material.

11. The apparatus of claim 10, wherein the at least one shock absorbing material includes polyurethane.

12. The apparatus of claim 6, wherein the shock absorbing mechanism includes a polyurethane bushing having a size and shape that corresponds with the size and shape of cavity.

13. A skateboard comprising:

a planar board having a top side and a bottom side;

a pair of suspension skateboard trucks mounted to the bottom side of the planar board, each suspension skateboard truck comprising:

a base having a plurality of mounting holes, a pivot cup, and a mounting seat that includes a kingpin receiving hole and bottom bushing seat;

a bottom bushing provided on the bottom bushing seat;

a hangar having a pivot stem pivotally coupled with the pivot cup, a bushing ring resting on the first bushing, and opposing axle sleeves that extend to opposite distal ends along a lateral axis defined by an axle channel formed by each axle sleeve, the distal end of each axle sleeve including a cavity that has a width greater than a width of the axle channel;

a top bushing provided on the top bushing seat;

a kingpin threaded through the top bushing, the bushing ring, the bottom bushing, and coupled to the kingpin receiving hole;

an axle extending out from the axle channel and cavity of the distal end of each axle sleeve; and a shock absorbing mechanism occupying each cavity at least partially around the axle; and four wheels, each wheel being mounted on each axle that extends out from the axle channel.

14. The skateboard of claim 13, wherein the cavity comprises a recess provided into an outer face of the distal end of each axle sleeve, the outer face defining a plane that is transverse to the lateral axis.

15. The apparatus of claim 14, wherein the recess has a truncated cone shape, and the shock absorbing mechanism includes a shock absorbing material formed in the truncated cone shape.

16. The apparatus of claim 14, wherein the recess is radially symmetric about the lateral axis.

17. The apparatus of claim 13, wherein the shock absorbing mechanism includes a shock absorbing member formed of at least one shock absorbing material.

18. The apparatus of claim 17, wherein the at least one shock absorbing material includes polyurethane.

19. The apparatus of claim 13, wherein the shock absorbing mechanism includes a polyurethane bushing having a size and shape that corresponds with the size and shape of cavity.

20. The apparatus of claim 17, wherein the shock absorbing mechanism includes two shock absorbing materials.

* * * * *